US011927390B2

(12) United States Patent
Cao et al.

(10) Patent No.: US 11,927,390 B2
(45) Date of Patent: Mar. 12, 2024

(54) MULTIPURPOSE PORTABLE VACUUM INSULATION ICE BUCKET

(71) Applicant: Shenzhen Reekoos Houseware Co., Ltd., Shenzhen (CN)

(72) Inventors: Rui Cao, Shenzhen (CN); Weiliang Gu, Shenzhen (CN)

(73) Assignee: Shenzhen Reekoos Houseware Co., Ltd.

( * ) Notice: Subject to any disclaimer, the term of this patent is extended or adjusted under 35 U.S.C. 154(b) by 192 days.

(21) Appl. No.: 17/563,115

(22) Filed: Dec. 28, 2021

(65) Prior Publication Data

US 2022/0120487 A1 Apr. 21, 2022

(51) Int. Cl.

| | |
|---|---|
| ***F25D 3/08*** | (2006.01) |
| ***A47G 23/02*** | (2006.01) |
| ***B65D 81/38*** | (2006.01) |
| ***F25D 31/00*** | (2006.01) |

(52) U.S. Cl.

CPC ..... *F25D 3/08* (2013.01); *B65D 81/3806* (2013.01); *B65D 81/3881* (2013.01); *F25D 31/007* (2013.01); *A47G 23/0241* (2013.01); *F25D 2331/809* (2013.01)

(58) Field of Classification Search

CPC .... F25D 3/08; F25D 31/007; F25D 2331/809; B65D 81/3806; B65D 81/3881; A47G 23/0241

USPC ..... 220/592.27

See application file for complete search history.

(56) References Cited

U.S. PATENT DOCUMENTS

| | | | | |
|---|---|---|---|---|
| 4,771,911 | A * | 9/1988 | Morony | B65D 11/16 220/592.16 |
| 9,651,299 | B1 * | 5/2017 | Duff | F25D 31/007 |
| 10,005,608 | B1 * | 6/2018 | Jacob | A47J 41/0038 |
| 11,697,546 | B2 * | 7/2023 | Jacob | B65D 47/06 220/254.1 |
| 2002/0088810 | A1 * | 7/2002 | Murakami | B65D 81/3881 220/739 |
| 2017/0071381 | A1 * | 3/2017 | Ze | F25D 3/08 |
| 2018/0242765 | A1 * | 8/2018 | Rane | A47G 23/0266 |
| 2019/0161246 | A1 * | 5/2019 | Lane | B65D 55/165 |
| 2021/0206534 | A1 * | 7/2021 | Yu | A47J 41/0077 |

(Continued)

*Primary Examiner* — J. Gregory Pickett
*Assistant Examiner* — Niki M Eloshway
(74) *Attorney, Agent, or Firm* — Jose Cherson Weissbrot

(57) ABSTRACT

The utility model discloses a multipurpose portable vacuum insulation ice bucket, which is technically characterized in that the multipurpose portable vacuum insulation ice bucket comprises a soft rubber lid, an inner lid is connected to a lower part of the soft rubber lid through rubber coating, and an outer lid is placed above the inner lid; and the inner lid is connected with an inner container through a thread, the inner container is welded with an outer container and an outer container bottom and vacuumized, a bottom of the inner container is provided with an inner container bottom, and inner container steps are arranged inside the inner container. The multipurpose portable vacuum insulation ice bucket has multiple functions because of the steps arranged inside, has the advantages of simple structure, easy use and high portability, and may adapt to chilled beverages of different sizes as needed, which effectively improves the use experience of consumers and reduces the use cost.

5 Claims, 5 Drawing Sheets

(56) References Cited

U.S. PATENT DOCUMENTS

| | | | | |
|---|---|---|---|---|
| 2022/0204213 | A1* | 6/2022 | Cheng | A47G 23/04 |
| 2022/0212856 | A1* | 7/2022 | Sweeney | B65D 81/3876 |

* cited by examiner

MULTIPURPOSE PORTABLE VACUUM INSULATION ICE BUCKET

BACKGROUND OF THE INVENTION

1. Technical Field

The utility model relates to a multipurpose portable vacuum insulation ice bucket.

2. Description of Related Art

Many people like alcoholic beverages such as red wine and champagne, which usually taste the best when chilled. Take champagne as an example. The best drinking temperature of champagne is 4-8° C. Champagne at this temperature is refreshing and fruity, which is a good summer drink. Champagne at normal temperature not only tastes blander, but also tends to explode when opened, causing waste and contamination. Using an ice bucket is the most common way of chilling beverages. Conventional ice buckets in the market are single-layer stainless steel ice buckets, which do not have the function of continuous heat preservation. Besides, in spite of their adaptability to different sizes of wine bottles, they are bulky and inconvenient to carry. Further, when conventional ice buckets are used, ice cubes and water need to be added into the ice buckets, then wine bottles are put in to achieve the purpose of chilling, but if the wine bottles stay in the ice buckets for too long, the serving temperature will be too low, which will affect the taste. The cumbersome operation and poor portability have always been criticized by consumers.

Therefore, the utility model provides a multipurpose portable vacuum insulation ice bucket, which will solve the above problems and be welcomed in the market with its adaptability to the sizes of most conventional wine bottles, portability and continuous heat preservation function.

BRIEF SUMMARY OF THE INVENTION

Aiming at the shortcomings of the prior art, the embodiment of the utility model aims to provide a multipurpose portable vacuum insulation ice bucket to solve the problems mentioned in the above background art.

A multipurpose portable vacuum insulation ice bucket comprises:

(i) a vacuum insulation container formed by an inner container, an outer container and an outer container bottom through welding and vacuumizing, (ii) a lid consisting of an inner lid, an outer lid and a soft rubber lid, and (iii) a bottom pad.

The inner container of the multipurpose portable vacuum insulation ice bucket is provided with steps.

An inner container thread of the multipurpose portable vacuum insulation ice bucket is matched with an inner lid thread.

Preferably, the outer container is provided with outer container depressions.

Preferably, the inner container thread is an internal thread.

Preferably, the inner lid thread is an external thread.

Preferably, the soft rubber lid is made of a soft material. More preferably, the soft material is TPR.

Preferably, the inner lid is made of a hard material. More preferably, the hard material is PP.

Preferably, the bottom pad is made of a soft material. More preferably, the soft material is silica gel.

To sum up, compared with the prior art, the embodiment of the utility model has the following beneficial effects:

The inner container is provided with the inner container steps, when in use, the lid is removed, a chilled conventional 750 ml red wine bottle or wine bottles of similar sizes are put in, an inner container bottom supports a bottom of the 750 ml red wine bottle or wine bottles of similar sizes, then the lid is tightened, the inner lid thread is coupled with the inner container thread, a neck of the conventional 750 ml red wine bottle or wine bottles of similar sizes is fixed by a soft rubber lid edge, and the multipurpose portable vacuum insulation ice bucket is adaptable to a conventional 750 ml red wine bottle or wine bottles of similar sizes; or the lid is removed, a chilled conventional 750 ml champagne bottle or wine bottles of similar sizes are put in, the inner container steps support a bottom of the 750 ml champagne bottle or wine bottles of similar sizes, then the lid is tightened, the inner lid thread is coupled with the inner container thread, a neck of the conventional 750 ml champagne bottle or wine bottles of similar sizes is fixed by the soft rubber lid edge, and the multipurpose portable vacuum insulation ice bucket is adaptable to a conventional 750 ml champagne bottle or wine bottles of similar sizes; other small beverage bottles/cans may also be put into the multipurpose portable vacuum insulation ice bucket; by means of the vacuum insulation performance of the multipurpose portable vacuum insulation ice bucket, the above-mentioned chilled beverages with different sizes may achieve a lasting cold insulation effect; and the multipurpose portable vacuum insulation ice bucket may also be directly used as a conventional beverage insulation container.

The multipurpose portable vacuum insulation ice bucket has multiple functions because of the steps arranged inside, has the advantages of simple structure, easy use and high portability, and may adapt to chilled beverages of different sizes as needed, which effectively improves the use experience of consumers and reduces the use cost.

In order to explain the structural features and efficacy of the utility model more clearly, the utility model will be described in detail with the attached drawings and specific embodiments.

Figure 1:
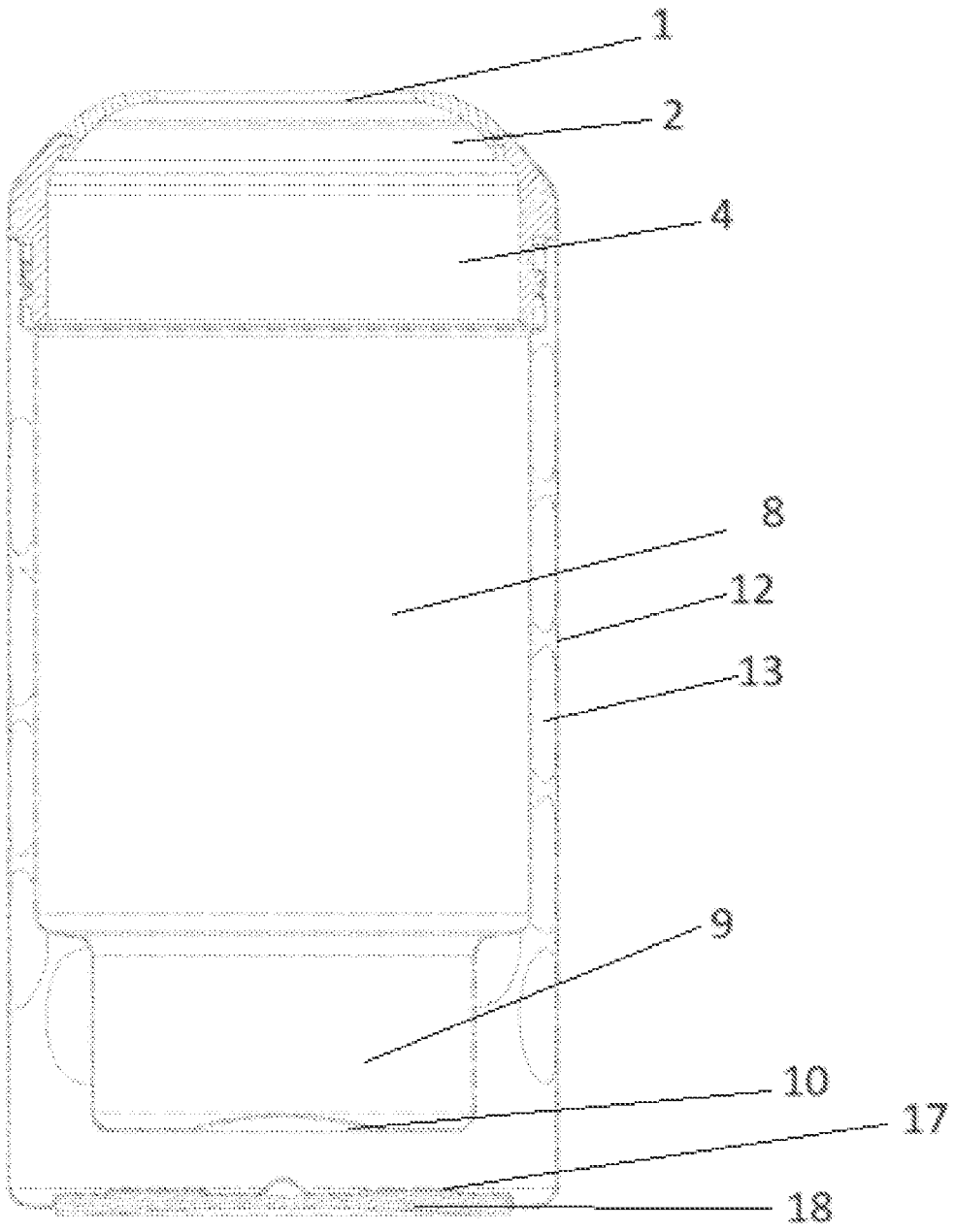
FIG. 1 is a diagram of an internal structure of an embodiment of the utility model.
Figure 2:
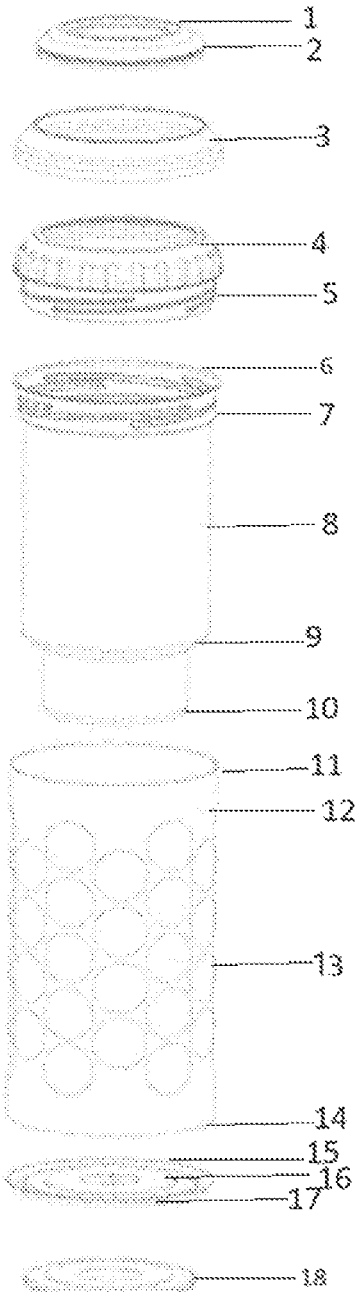
FIG. 2 is an exploded view of an embodiment of the utility model.

Reference numerals: soft rubber lid edge (1), soft rubber lid (2), outer lid (3), inner lid (4), inner lid thread (5), inner container and outer container welding position (6) on inner container, inner container thread (7), inner container (8), inner container step (9), inner container bottom (10), inner container and outer container welding position (11) on outer container, outer container (12), outer container depression (13), outer container and outer container bottom welding position (14) on outer container, outer container and outer container bottom welding position (15) on outer container bottom, vacuumizing position (16) of outer container bottom, outer container bottom (17) and bottom pad (18).

DETAILED DESCRIPTION OF THE INVENTION

In order to make the purpose, technical scheme and advantages of the utility model more clear, the utility model will be further explained in detail below with reference to the attached drawings and embodiments. The specific embodiments described here are only used to explain the utility model, not to limit the utility model.

The specific implementation of the utility model is described in detail below with specific embodiments.

Embodiment

Please refer to FIGS. 1-4, according to an embodiment provided by the utility model, a multipurpose portable vacuum insulation ice bucket comprises a soft rubber lid edge (1), a soft rubber lid (2), an outer lid (3), an inner lid (4), an inner lid thread (5), an inner container and outer container welding position (6) on an inner container, an inner container thread (7), an inner container (8), inner container steps (9), an inner container bottom (10), an inner container and outer container welding position (11) on an outer container, an outer container (12), outer container depressions (13), an outer container and outer container bottom welding position (14) on the outer container, an outer container and outer container bottom welding position (15) on an outer container bottom, a vacuumizing position (16) of an outer container bottom, an outer container bottom (17) and a bottom pad (18).

The inner container 8 and the outer container 12 are connected by welding at the inner container and outer container welding position 6 on the inner container and the inner container and outer container welding position 11 on the outer container. The outer container 12 and the outer container bottom 17 are connected by welding at the outer container and outer container bottom welding position 14 on the outer container and the outer container and outer container bottom welding position 15 on the outer container bottom. A formed container is vacuumized at the vacuumizing position 16 of the outer container bottom to form the multipurpose portable vacuum insulation ice bucket together with a lid.

The soft rubber lid 2 is connected with the inner lid 4 through rubber coating, and the inner lid thread is matched with the inner container thread.

An outer side of the outer container 12 is provided with the outer container depressions 13 to facilitate grasping for users.

The bottom pad 18 is preferably made of silica gel, which has an anti-slip function in use.

The inner container steps 9 are arranged in the inner container 8, so that the multipurpose portable vacuum insulation ice bucket may adapt to wine bottles of different sizes while ensuring portability.

When in use, the lid is removed, a chilled conventional 750 ml red wine bottle is put in, the inner container bottom supports a bottom of the 750 ml red wine bottle, then the lid is tightened, the inner lid thread is coupled with the inner container thread, a neck of the conventional 750 ml red wine bottle is fixed by the soft rubber lid edge, and the multipurpose portable vacuum insulation ice bucket is adaptable to a conventional 750 ml red wine bottle; or the lid is removed, a chilled conventional 750 ml champagne bottle is put in, the inner container steps support a bottom of the 750 ml champagne bottle, then the lid is tightened, the inner lid thread is coupled with the inner container thread, a neck of the conventional 750 ml champagne bottle is fixed by the soft rubber lid edge, and the multipurpose portable vacuum insulation ice bucket is adaptable to a conventional 750 ml champagne bottle; and by means of the vacuum insulation performance of the multipurpose portable vacuum insulation ice bucket, the above-mentioned chilled beverages with different sizes may achieve a lasting cold insulation effect.

Figure 3:
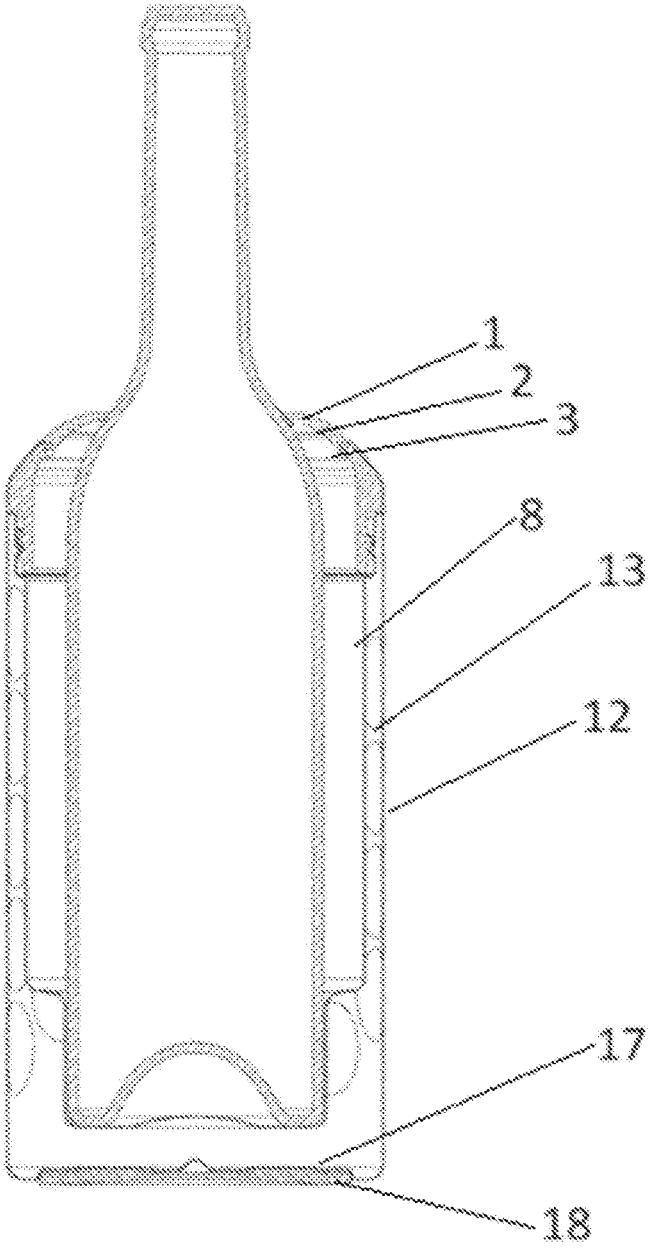
FIG. 3 is a structural diagram showing that a 750 ml conventional red wine bottle is put in an embodiment of the utility model.

As shown in FIG. 3, the lid is removed, a chilled conventional 750 ml red wine bottle is put in, the inner container bottom supports a bottom of the 750 ml red wine bottle, then the lid is tightened, the inner lid thread is coupled with the inner container thread, a neck of the conventional 750 ml red wine bottle is fixed by the soft rubber lid edge, and the multipurpose portable vacuum insulation ice bucket is adaptable to a conventional 750 ml red wine bottle. The vacuum insulation performance of the container allows a conventional 750 ml red wine bottle to have a lasting cold insulation effect.

Figure 4:
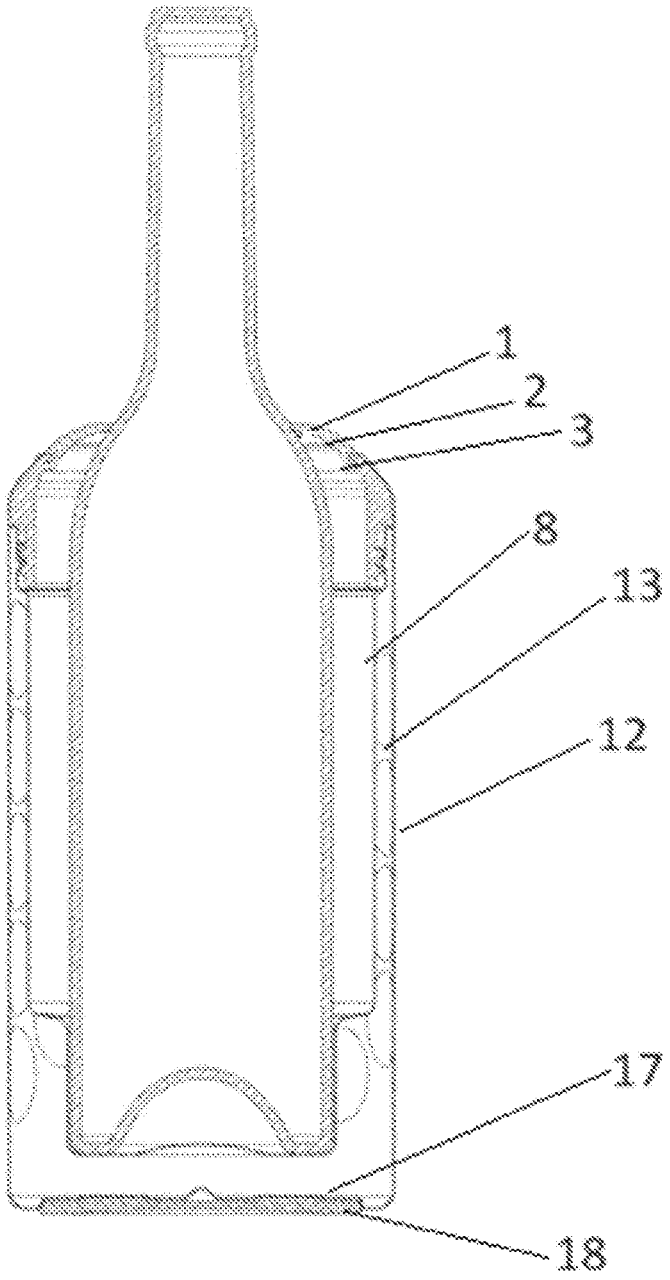
FIG. 4 is a structural diagram showing that a 750 ml conventional champagne bottle is put in an embodiment of the utility model.
Figure 5:
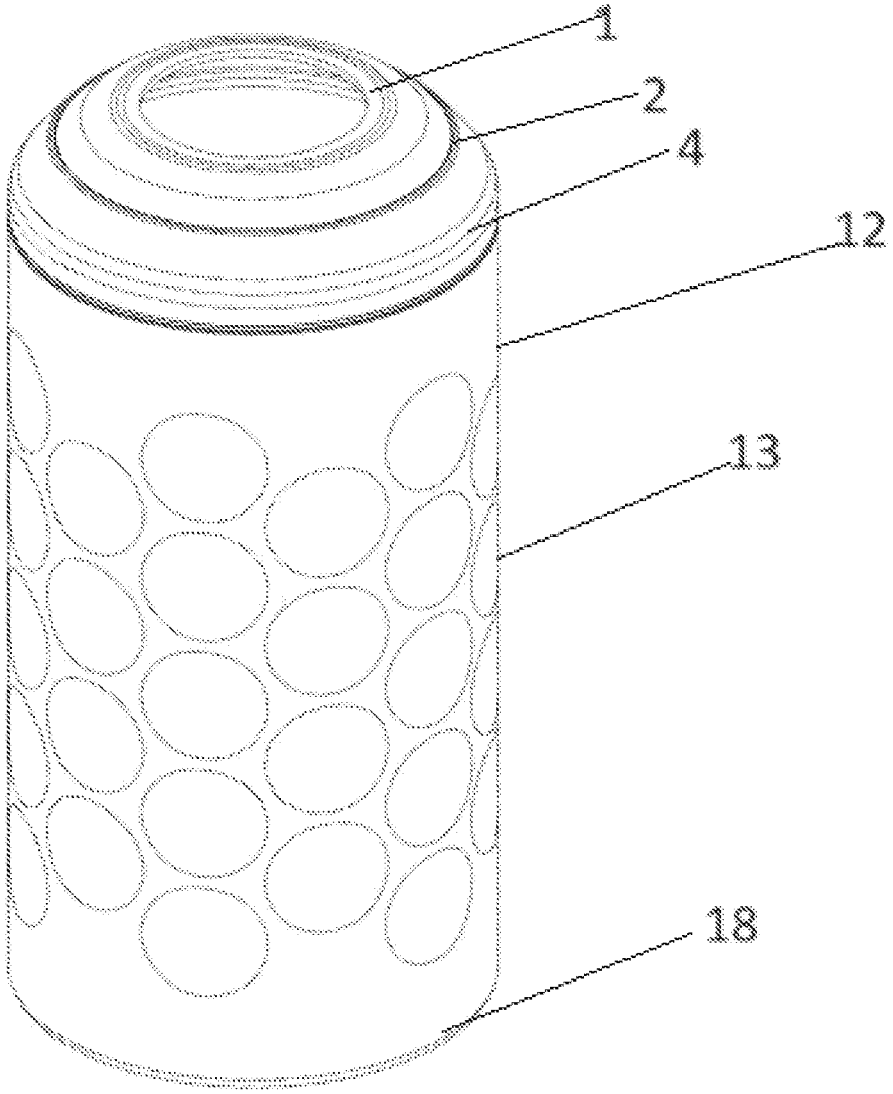
FIG. 5 is a diagram of a three-dimensional structure of a multipurpose portable vacuum insulation ice bucket according to an embodiment of the utility model.

As shown in FIG. 4, the lid is removed, a chilled conventional 750 ml champagne bottle is put in, the inner container steps support a bottom of the 750 ml champagne bottle, then the lid is tightened, the inner lid thread is coupled with the inner container thread, a neck of the conventional 750 ml champagne bottle is fixed by the soft rubber lid edge, and the multipurpose portable vacuum insulation ice bucket is adaptable to a conventional 750 ml champagne bottle. The vacuum insulation performance of the container allows a conventional 750 ml champagne bottle to have a lasting cold insulation effect.

The working principle of the utility model is as follows: through the design of the inner container steps, the inner container may adapt to at least two kinds of wine bottles with different diameters and sizes, thus realizing multiple functions and portability; by means of the soft characteristics of the soft rubber lid edge, the soft rubber lid may fix various wine bottles with different neck diameters; and by means of the vacuum insulation performance of the multipurpose portable vacuum insulation ice bucket, the above-mentioned chilled beverages with different sizes may achieve a lasting cold insulation effect.

The foregoing are only preferred embodiments of the utility model, and are not intended to limit the utility model. Any modifications, equivalent substitutions, improvements, etc. made within the spirit and principles of the utility model shall be included in the scope of protection of the utility model.

What is claimed is:

1. A multipurpose portable vacuum insulation ice bucket, comprising:

a soft rubber lid (2) having a soft rubber lid edge (1), the soft rubber lid (2) defining an upper end and a lower end, wherein the upper end of the soft rubber lid (2) is provided with the soft rubber lid edge (1) to configured to fix a neck of a bottle, when the bottle is received in the multipurpose portable vacuum insulation ice bucket;

an inner lid (4) coupled to the lower end of the soft rubber lid (2), the inner lid (4) having an inner lid thread (5), the inner lid (4) having an outer surface, the outer surface defining an upper side and a lower side, wherein the lower side of the outer surface of the inner lid (4) is provided with the inner lid thread (5);

an outer lid (3) placed on the upper side of the outer surface of the inner lid (4);

an inner container (8) having an inner container and outer container welding position (6) on the inner container provided at a top of the inner container, an inner container thread (7) provided on an inner surface of an upper side of the inner container (8), wherein the inner lid (4) connected with the lower end of the soft rubber lid (2) is matched with the inner container thread (7) arranged on the inner surface of the upper side of the inner container (8), inner container steps (9) arranged inside the inner container (8), an inner container bottom (10) provided at a bottom of the inner container (8);

an outer container (12) arranged outside the inner container (8), the outer container (12) having an inner container and outer container welding position (11) on the outer container provided on an upper side of the outer container (12), outer container depressions (13) provided on an outer surface of the outer container (12), an outer container and outer container bottom welding position (14) on the outer container provided at a lower side of the outer container (12), wherein the inner container (8) and the outer container (12) are connected by welding at the inner container and outer container welding position (6) on the inner container and the inner container and outer container welding position (11) on the outer container; and an outer container bottom (17) arranged below the outer container (12), the outer container bottom (17) having an outer container and outer container bottom welding position (15) on the outer container bottom provided at an upper side of the outer container bottom (17), and a vacuumizing position (16) of the outer container bottom provided at a center of the outer container bottom (17), wherein the outer container (12) and the outer container bottom (17) are connected by welding at the outer container and outer container bottom welding position (14) on the outer container and the outer container and outer container bottom welding position (15) on the outer container bottom, and a bottom pad (18) provided below the outer container bottom (17), wherein the multipurpose portable vacuum insulation ice bucket is formed after vacuumizing through the vacuumizing position (16) of the outer container bottom.

2. The multipurpose portable vacuum insulation ice bucket according to claim 1, wherein the inner container (8) is configured to adapt to the bottle of a 750 ml red wine bottle or a wine bottle.

3. The multipurpose portable vacuum insulation ice bucket according to claim 2, wherein the soft rubber lid edge (1) fixes a neck of the red wine bottle or the wine bottle, when the 750 ml red wine bottle or the wine bottle is placed in the multipurpose portable vacuum insulation ice bucket, and the inner lid thread (5) is coupled with the inner container thread (7).

4. The multipurpose portable vacuum insulation ice bucket according to claim 2, wherein the inner container steps (9) are configured to support a bottom of the bottle of a 750 ml champagne bottle or a wine bottle to adapt to the 750 ml champagne bottle or the wine bottle.

5. The multipurpose portable vacuum insulation ice bucket according to claim 4, wherein the soft rubber lid edge (1) fixes a neck of the 750 ml champagne bottle or a wine bottle, when the 750 ml champagne bottle or the wine bottle is placed in the multipurpose portable vacuum insulation ice bucket, and the inner lid thread (5) is coupled with the inner container thread (7).

* * * * *